US005254061A

United States Patent [19]

Leask

[11] Patent Number: 5,254,061

[45] Date of Patent: * Oct. 19, 1993

[54] EDDY CURRENT BRAKING SYSTEM

[75] Inventor: John C. Leask, Mason, N.H.

[73] Assignee: Anisquam Equipment Corp., Anisquam, Mass.

[ * ] Notice: The portion of the term of this patent subsequent to Jul. 16, 2008 has been disclaimed.

[21] Appl. No.: 932,278

[22] Filed: Aug. 19, 1992

Related U.S. Application Data

[63] Continuation of Ser. No. 682,668, Apr. 9, 1991, abandoned, which is a continuation of Ser. No. 460,756, Jan. 4, 1990, Pat. No. 5,031,900.

[51] Int. Cl.[5] ..... A63B 22/06; A63B 21/005

[52] U.S. Cl. ..... 482/63; 482/5; 482/903

[58] Field of Search ..... 482/63, 903, 1, 5, 6, 482/7; 335/297; 364/152

[56] References Cited

U.S. PATENT DOCUMENTS

| | | | |
|---|---|---|---|
| 2,208,415 | 7/1940 | Franck et al. | 335/297 |
| 4,084,810 | 4/1978 | Forsman | 482/903 |
| 4,470,597 | 9/1984 | McFee | 482/903 |
| 4,495,560 | 1/1985 | Sugimoto | 364/152 |
| 4,752,066 | 6/1988 | Honsayama | 482/63 |
| 4,775,145 | 10/1988 | Tsuyama | 272/73 |
| 4,826,150 | 5/1989 | Minoura | 272/129 |
| 4,838,544 | 6/1989 | Sasakawa et al. | 272/73 |
| 5,031,900 | 7/1991 | Leask | 272/129 |

*Primary Examiner*—Stephen R. Crow
*Attorney, Agent, or Firm*—Robert K. Tendler

[57] ABSTRACT

An improved eddy current braking system for fly wheel braked exercise equipment includes the use of a flat aluminum disc and electromagnets to either side of the disc adjacent to the periphery thereof, with the electromagnets containing multiple pole pieces to multiply the torque so as to reduce heating and power consumption. The utilization of aluminum achieves a flat torque versus speed characteristic vis-a-vis copper discs over the normal operating speed range. Additionally, the utilization of aluminum prevents the warpage associated with copper.

3 Claims, 2 Drawing Sheets

EDDY CURRENT BRAKING SYSTEM

RELATED CASES

This is a continuation of copending application Ser. No. 682,668 filed on Apr. 9, 1991, now abandoned which is a continuation of pending application, Ser. No. 460,756, filed Jan. 4, 1990 entitled Eddy Current Braking System, now Pat. No. 5,031,900.

FIELD OF INVENTION

This invention relates to exercise apparatus and more particularly to an eddy current brake for providing a constant torque for the exercise apparatus.

BACKGROUND OF THE INVENTION

Exercise devices are known in which exercise causes rotary motion of a member, with the rotary motion being opposed by various braking mechanisms. Typical of rowing or bicycling apparatus is a friction brake which applies a frictional retarding force to a fly wheel. One of the major problems with such a braking system is the so called break away torque necessary to start the fly wheel in motion at the beginning of the exercise. Note, an unusual amount of user force is necessary in order to overcome this break away torque, which makes exercise uncomfortable. Typical friction braking devices are described in U.S. Pat. Nos. 1,974,445; 2,725,231; and 2,512,911. Friction brake devices are also described in the following publication: "A constant-torque brake for use in bicycle and other ergometers," J. Y. Harrison J. App. Phys. Vol. 23, No. 6, Dec. 1967.

Electromagnetic braking systems have also been utilized in exercise equipment, the most common of which being an alternator which provides a retarding force against which the user exercises. Such devices are illustrated by U.S. Pat. Nos. 857,447; 3,442,131; 3,555,326; 4,060,239; 4,082,267 and 4,084,810. Other brakes for exercise apparatus are shown in U.S. Pat. Nos. 625,905; 683,124; 782,010, 783,769; 1,239,077; 3,497,215; 3,558,130; 3,586,322; 3,592,466; 3,711,812; 3,765,245; 3,962,595; 4,047,715; 4,085,344; 4,112,928; 4,130,014; 4,298,893; 4,347,993; 4,350,913; 4,396,188; 4,416,293; 4,512,566; 4,687,195; 4,708,338; and 4,798,378. Various foreign patents showing exercise equipment include SU 869,781; DT 2,830-691; GER 743,133; IT 468,973; SW 7706-583; SU 371,950; and DEN. 83817.

Of particular interest are ferromagnetic eddy current type braking systems in which the pole faces of the electromagnets are placed outside a ferromagnetic rim of the fly wheel employed. One of the major problems with such a device is the break away torque due to residual magnetism. Moreover, due to the placement of the electromagnetic pole faces outside the fly wheel when the fly wheel is heated due to the braking process, the wheel expands and binds against the pole pieces. An additional problem with such expansion is that the expansion is in a direction which varies the gap between the rim of the fly wheel and the pole piece. The result is that due to thermal expansion, an increasing torque is applied, with the relationship between the expansion and the additional torque being non-linear. Such a ferrous metal eddy current brake is shown in U.S. Pat. No. 4,798,378 in which a ferrous rim is placed opposite a stationary electromagnet.

By way of further background, as illustrated in an article entitled "A Bicycle Ergometer with Electric Brake," by Frances G. Benedict and Walter C. Cady in the Carnegie Institution of Washington Journal in 1912, a bicycle ergometer is proposed in which a copper disc is positioned between the pole pieces of electromagnets with the pole pieces being on diametrically opposite sides of the copper disc. While the system described by Benedict et al. produces an eddy current braking system which is effective in producing a retarding torque, the utilization of copper presents a number of problems.

Perhaps the first and most important problem is that the copper warps during usage due to thermal expansion characteristics and due to its inherent ductility. The problem then becomes maintaining the spacing between the opposed pole pieces so as to provide a regulatable constant torque during the period of exercise. It will be appreciated that the provision of a constant torque for a constant setting dialed in by the user is important because during the period of exercise which may last as long as an hour or two, the physical characteristics of the braking system normally change due to thermal expansion of the mechanical parts. The result is neither proper calibration nor comfort for the user of the exercise device, due to constant adjustments which must be made in order to maintain constant torque.

Thermal considerations aside, variation in torque with speed of exercise is unacceptable. Prior problems in the variation of torque with speed are described in the following articles: C. Lanooy & F. H. Bonjer, "A Hyperbolic Ergometer For Cycling & Cranking", J. Appl. Physiol. vol. 9, pp. 499–500, 1956, in which a copper disc was utilized in an eddy current braking system, and A. Krogh, "A Bicycle Ergometer and Respiration Apparatus For The Experimental Study of Muscular Work", Skand. Arch. Physiol. 33, pp. 375–394, 1913, in which work per revolution is said to vary with speed of the copper disc.

Thus, it is a design goal to achieve constant torque over a wide range of rotary speeds of the disc. Additionally, it is also important that the torque be constant throughout the period of exercise. Copper, while being an extremely good electrical conductor, has a problem that the torque delivered by the system employing the copper disc is neither relatively flat or constant for the range of exercise intended; nor is the torque provided by the eddy current/copper disc system controllable without elaborate feedback systems. Thus, for instance, the response of such a system to variations in pedal rotation of between 40 and 100 rpm is that, for a constant setting, the retarding torque is highly dependent upon the rotary speed of the pedals. The result for the end user is that there is an extremely annoying difference in the retarding force when pedaling at different speeds.

The variability of the retarding torque is more troublesome in medical applications when it is important that a constant torque be presented to the user of the exercise device in order to obtain proper measurement of exercise activity.

SUMMARY OF THE INVENTION

In order to solve the problems of the non-uniform torque and warping associated with copper discs, in the Subject Invention an aluminum disc is utilized. However, due to its decreased electrical conductivity vis-a-vis copper, the disc in one configuration is to be run at 320 to 800 rpm with an 8 to 1 ratio between the rotational speed of the disc and pedal speed. Also due to the lower electrical conductivity, a specialized 3 pole electromagnet is utilized at the periphery of the disc to multiply the magnetic flux by a factor of 3. This provides adequate braking while at the same time not inducing excessive amounts of heat.

It will also be noted that the opposed electromagnets are located on a line transverse to the plane of the disc. This allows thermal expansion of the disc without affecting the operation of the system. It will be appreciated that as the aluminum disc expands, it expands in a direction transverse to the line between the poles of the opposed electromagnets. In this embodiment the wheel is sandwiched between the two electromagnets. Thus the spacing between a pole and corresponding disc surface can be maintained constant.

The result of utilizing an appropriately spun up aluminum disc is that for a given current through the electromagnets, the retarding torque is constant between normal 40 and 100 rpm pedal speeds.

It will be appreciated that the subject aluminum disc has at least seven times the stiffness of copper, such that warpage is not a problem during thermal expansion. Nor is there any binding between the disc and the pole faces of the electromagnets. Also there is virtually no break away torque associated with such a system which leads to user comfort.

While it will be appreciated that the Subject Invention will be described in connection with bicycle-type exercise devices, the invention is not limited to the utilization of such an aluminum disc/eddy current braking system with an exercise bicycle. Rather, the Subject System may be utilized in any exercise device which causes rotary motion of a member coupled to the Subject eddy current braking system. As such rowing machines, stair climbing type apparatus or indeed any other type of apparatus which requires a braking torque are within the scope of the Subject Invention.

It has been found that an aluminum disc provides the unexpected result of an exceptionally flat torque response over the operating range of the system. Moreover, due to the structural stability of aluminum itself, as well as its light weight, warpage problems are eliminated. Additionally, calibration of the equipment is made relatively simple due to the constant torque applied for a constant current or voltage. Thus, problems in calculating the amount of work done or the amount of exercise of a given individual is made exceedingly simple due to this braking system which requires no feedback loops or circuits to maintain the constant retarding force.

In summary, an improved eddy current braking system for fly wheel braked exercise equipment includes the use of a flat aluminum disc and electromagnets to either side of the disc adjacent to the periphery thereof, with the electromagnets containing multiple pole pieces to multiply the torque so as to reduce heating and power consumption. For a constant setting, the utilization of aluminum achieves a flat torque versus speed characteristic vis-a-vis copper discs over the normal operating speed range. Additionally, the utilization of aluminum prevents the warpage associated with copper.

Even though copper has better electrical conductivity than aluminum which permits lower speed operation, it has been found that an aluminum fly wheel permits obtaining the same torque as with the prior art copper discs assuming geared spin up of the fly wheel. The utilization of aluminum has advantage over prior art ferrous metal eddy current brakes in that there is no residual magnetism which results in large break away torques to be provided. Nor when using aluminum is there a problem of displacement of the periphery of the disc in a lateral direction as is the case were one to position magnets to either side of a ferrous disc.

Moreover, because the magnetic pole pieces are placed to either side of the disc as opposed to inwardly directed along a radius at the periphery of the disc, clearance problems associated with the thermal expansion of the disc are eliminated in that the disc is allowed to radially expand with an increase in temperature without affecting the spacing between the disc and the pole pieces.

BRIEF DESCRIPTION OF DRAWINGS

These and other features of the Subject Invention will be better understood in connection with the Detailed Description taking in connection with the Drawings of which.

DETAILED DESCRIPTION

Figure 1:
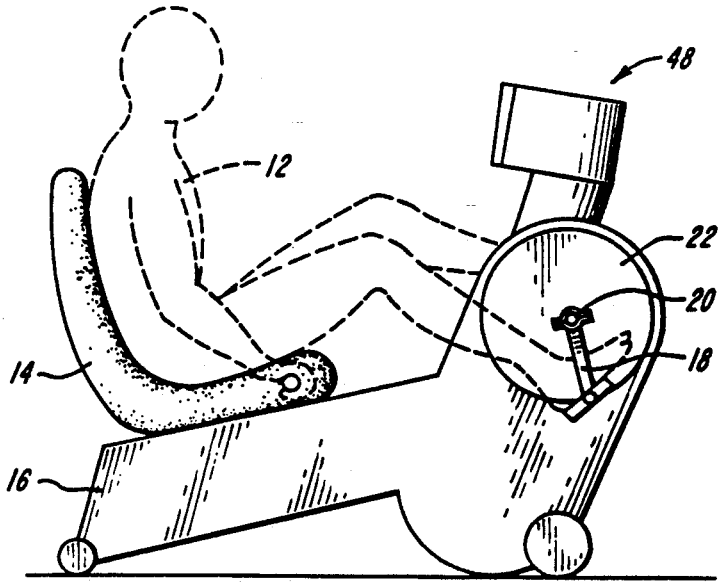
FIG. 1 is a side and diagrammatic view of the utilization of the Subject Invention in a recumbent bicycle exercise machine in which the pedals are utilized to drive an eddy current brake provided with an aluminum disc.
Figure 2:
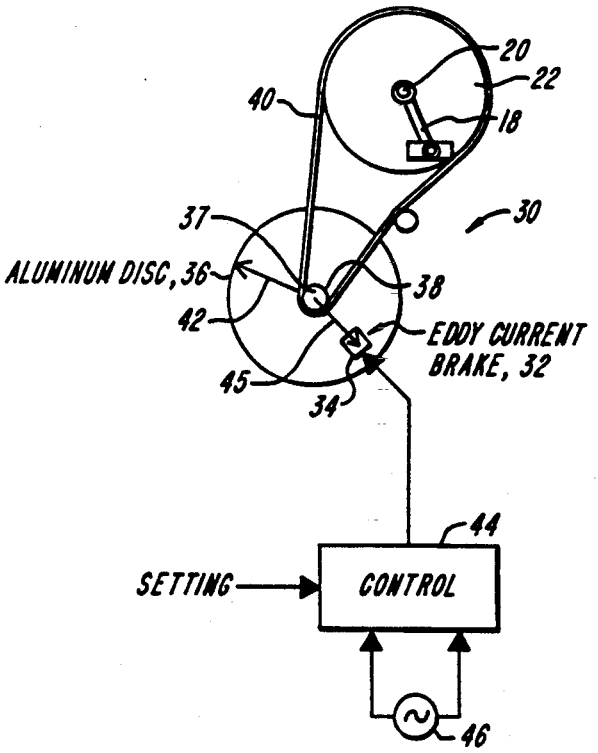
FIG. 2 is a diagrammatic and schematic diagram of the Subject System illustrating the utilization of an eddy current brake/aluminum disc system in which the aluminum disk is rotated about a shaft via a belt-driven pedal assembly.

Referring now to FIG. 1, a typical exercise machine 10 is illustrated, which may be a recumbent bicycle-type exercise machine in which an individual 12 is located on a seat 14 on frame 16 which houses a braking device for pedals 18 that revolve around a shaft 20. The pedals are coupled to a wheel 22 mounted for rotation in the housing, with wheel 22 being braked as illustrated in FIG. 2 by a braking system 30 which includes an eddy current brake 32 including electromagnetically actuated coils 34 to either side of a flat aluminum disc 36 which is mounted for rotation about a shaft 37. In the illustrated embodiment, a spin up 8:1 reduction system is illustrated in which there is an 8 to 1 difference in diameter between pulley 38 and wheel 22. Note the linkage between the two is via a belt drive 40. In the embodiment shown, the aluminum disc has a diameter 42 of 14 inches, whereas each electromagnet is maintained at a distance of 12 inches from shaft 37 as illustrated by arrow 45.

The eddy current brake 32 is under control of a control unit 44 which is supplied with a.c. as illustrated at 46. This control is settable from instrument cluster 48 in FIG. 1 so as to provide a constant braking torque to disc 36 and thus pedals 18 for constant current.

Figure 5:
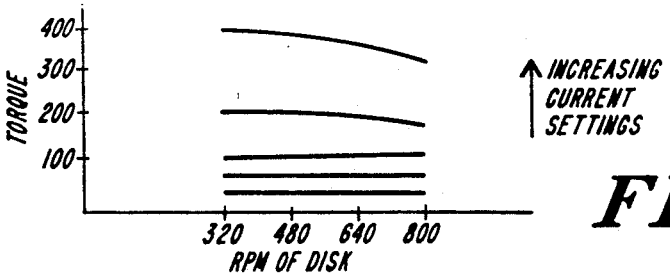
FIG. 5 is a graph showing torque versus speed of an aluminum disc for a single reduction system having a ratio of 8:1 for a 14 inch diameter aluminum disc, with magnets on 12 inch diameters, illustrating that within the normal operating range the torque versus rpm curve is relatively flat for various current settings, thereby facilitating brake setting and measurement of the work done by the exercising individual; and, FIG. 6 is a graph showing torque versus speed for a double reduction system in which there is a 21.8:1 ratio for a 10 inch diameter aluminum disc, with magnets on 8 inch diameters.
Figure 6:
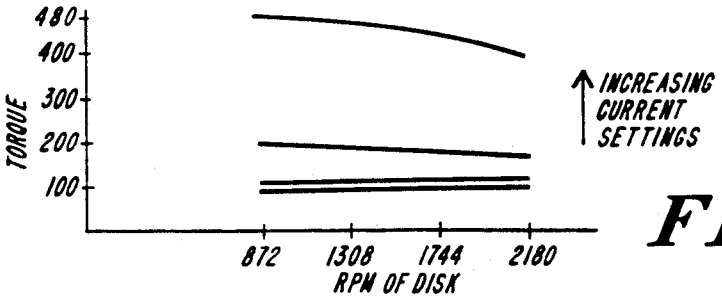

Because the disc is made out of aluminum, as will be demonstrated in FIGS. 5 and 6, the torque applied to disc 36 is flat over the operating speed range of the disc. What this means is that for a pedaling speed range of 40 to 100 rpm, the corresponding speed of the disc is between 320 and 800 rpm. As will be demonstrated for almost all constant current settings, there is very little change in torque versus speed. Thus, unlike prior art systems in which there is either a linear or hyperbolic relationship between speed and torque, in the Subject System it has been found that the torque is relatively flat over the operating speeds of interest due to the use of aluminum for the disc.

This provides user 12 of FIG. 1 with an exceptional amount of consistency of applied torque regardless of the pedaling speed. This in turn makes adjustment of the braking force for exercise much easier and more predictable than in prior art eddy current devices. Moreover, measurement of the actual work done is more accurately predictable from the power consumed in the braking system so that critical medical measurements can be made for exercise devices utilizing the eddy current brake in combination with the rotating aluminum disc. Brake away torque is virtually non-existent in aluminum disc systems and, because the aluminum disc is non-magnetic, there is no residual magnetism for which compensation is necessary. Also it is a feature of the Subject Invention that any aluminum moving member may be utilized in the subject eddy current brake, regardless of shape.

Moreover, because the pole pieces of the opposed magnets which sandwich the aluminum disc are to either side of the disc, as opposed to being positioned at its periphery, and since thermal expansion occurs in the radial direction only, the spacing between the pole pieces and the disc surface is maintained relatively constant regardless of the amount of heating accompanying the exercise.

Figure 3:
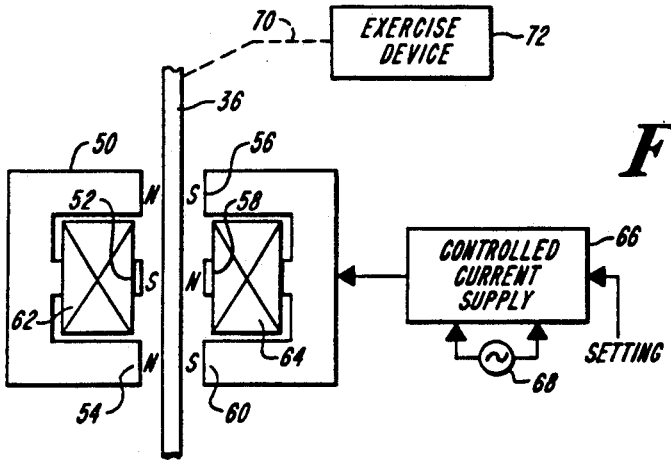
FIG. 3 is a diagrammatic illustration of the specialized three pole yoke for the electromagnets used by the Subject System to provide enhanced eddy current braking for the aluminum disc.

One of the features of the subject system is illustrated in FIG. 3 in which the electromagnets which sandwich disc 36 have a three pole E-shaped yoke configuration to magnify the eddy current effect by 3 times over a single pole piece yoke. In this embodiment three pole pieces 50, 52, and 54, respectively north, south, and north, are opposed by opposite polarity pole pieces 56, 58, and 60, with the E-shaped yoke oriented such that a line through the ends of the pole pieces is perpendicular to the radius of the disc for maximum braking torque. It will be noted that each of the electromagnets includes an energizing coil 62 and 64 respectively, each of which is energized through the supply of current from a controlled current supply 66 which has a.c. power 68 applied thereto and which is settable as illustrated. Disc 36 is rotated about a shaft which is mechanically coupled as illustrated at 70 to an exercise device Because of the triple pole configuration of the yoke for each electromagnet, for a given amount of current, the eddy current effect is magnified by 3 times over that associated with a single pole electromagnet. The purpose of utilizing the triple pole configuration is in part to reduce the amount of power necessary to provide the predetermined braking force. However, a more important reason for the utilization of the triple pole magnet is to permit the utilization of the aluminum disc and the advantages which flow therefrom.

It can therefore be seen that the eddy current effect takes place over a larger portion of the aluminum disc than heretofor performed. The result in that the amount of torque is multiplied over the utilization of a single pole.

Figure 4:
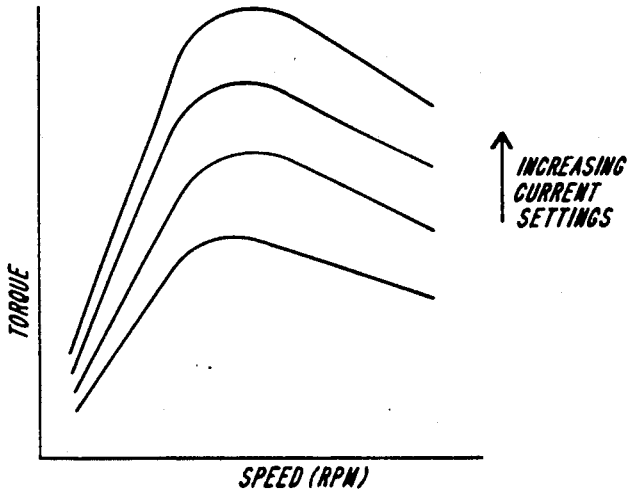
FIG. 4 (PRIOR ART)
FIG. 4 is a graph illustrating a prior art torque versus speed curve for prior art eddy current brakes indicating the hyperbolic nature of the curves.

As illustrated in FIG. 4, one type of prior art eddy current system, that shown in U.S. Pat. No. 3,442,131 issued to Jay Leyton of May 6, 1969, describes the extreme dependence of torque on speed. While in this patent it is said that it is preferable to operate the system at a linear portion of the curve, there is still an increase in torque of for an increase in pedal speed. Thus, rather than providing a constant torque for all usable pedal speeds, the Leyton device describes an increase in torque with pedal speed, albeit quasi-linear.

In contradistinction to this prior art torque versus speed characteristic, in the Subject System for a single reduction ratio of 8:1 the response of the torque is relatively flat for increased current settings. One plausible reason for the flatness of the torque versus speed characteristic is the lower electrical conductivity of the aluminum itself.

This same flat response is illustrated in FIG. 6 for a double reduction system in which the total reduction is 21.8:1, with a 10 inch diameter disc and magnets located on 8 inch diameters to either side of the disc. Note that the speeds of the discs are as indicated and correspond to a normal pedaling range of between 40 and 100 rpm.

While the subject invention has been described in connection with a rotary aluminum disc powered via bicycle type exercise apparatus, it will be appreciated that other types of exercise apparatus are within the scope of this invention, assuming that the exercise apparatus requires a constant torque braking system.

Having above indicated a preferred embodiment of the present invention, it will occur to those skilled in the art that modifications and alternatives can be practiced within the spirit of the invention. It is accordingly intended to define the scope of the invention only as indicated in the following claims:

I claim:

1. In exercise apparatus having a rotary part which is driven by the hand or foot of an individual in which movement of said rotary part is countered by the utilization of an eddy current brake in which a moving conductor in the form of a disc is passed adjacent magnets, the improvement of providing that said conductor be substantially exclusively aluminum in any eddy current generating area and providing that said eddy current brake has a force multiplying head to one side of said disc adjacent said eddy current generating area for imparting eddy current braking force of sufficient magnitude to effectively counter the movement of said rotary part unaugmented by other magnetic force generating means, said force multiplying head including an electro-magnet having multiple pole pieces pointing in the same direction and at least one coil surrounding at least one pole piece and to which current is supplied, whereby said force multiplication permits the utilization of an aluminum disc to provide sufficient brake power for exercise apparatus, said eddy current brake being the sole resistance to movement of said rotary part.

2. The apparatus of claim 1 wherein said eddy current brake includes magnetic force generating means to either side of said disc, with said disk being sandwiched therebetween.

3. The apparatus of claim 2 wherein said eddy current brake includes one of said force multiplying heads to either side of said disc.

* * * * *